US007013962B2

(12) United States Patent
Sanatgar et al.

(10) Patent No.: US 7,013,962 B2
(45) Date of Patent: Mar. 21, 2006

(54) HIGH PRESSURE FLUID COOLER

(76) Inventors: Homayoun Sanatgar, P.O. Box 3911, Rancho Cucamonga, CA (US) 91729; Gary F. Johnson, 22529 Jeniel Ct., Santa Clarita, CA (US) 91350; Neil Holt, P.O. Box 289, Crestline, CA (US) 92325

( * ) Notice: Subject to any disclaimer, the term of this patent is extended or adjusted under 35 U.S.C. 154(b) by 0 days.

(21) Appl. No.: 10/897,253

(22) Filed: Jul. 23, 2004

(65) Prior Publication Data

US 2006/0016584 A1 Jan. 26, 2006

(51) Int. Cl.
*F28D 1/03* (2006.01)

(52) U.S. Cl. ..... 165/152; 165/153; 165/179

(58) Field of Classification Search ..... 165/152, 165/153, 179

See application file for complete search history.

(56) References Cited

U.S. PATENT DOCUMENTS 5,036,911 A * 8/1991 So et al. ..... 165/153
5,875,834 A * 3/1999 Brooks ..... 165/153
5,964,282 A * 10/1999 Seiler et al. ..... 165/153
6,220,340 B1 * 4/2001 Cheong et al. ..... 165/153
6,394,176 B1 * 5/2002 Marsais ..... 165/153
6,401,804 B1 * 6/2002 Shimoya et al. ..... 165/133
6,889,758 B1 * 5/2005 Burgers et al. ..... 165/152
2002/0139520 A1 * 10/2002 Pinto ..... 165/153

* cited by examiner

*Primary Examiner*—Teresa J. Walberg
(74) *Attorney, Agent, or Firm*—Gary Appel

(57) ABSTRACT

A fluid cooler assembly comprises a vertically stacked first type and second different type of tubular panel subassembly construction integrated with a third subassembly of external corrugated fin construction positioned above and below each tubular panel subassembly. The first type tubular panel subassembly has an internal central flow region configured with a bilateral linear flow channeled subregion adapted for controlling the hydraulic behavior of the internal tubular coolant fluid flow. The second tubular panel subassembly has an internal tubular central flow channel region configured with a bilateral cross-flow channel region adapted for optimizing heat transfer. The integrated third subassembly of corrugated fin construction is externally positionally fixed above and below each tubular panel subassembly and is configured to increase the fluid cooler assembly heat transfer surface area and thus improve heat transfer cooling from the internal coolant fluid to the external fluid surrounding the fluid cooler assembly.

20 Claims, 5 Drawing Sheets

HIGH PRESSURE FLUID COOLER

BACKGROUND OF THE INVENTION:

1. Field of the Invention

The present invention relates generally to the field of heat exchangers, and more particularly to high pressure fluid coolers.

2. Background Discussion

Many types of fluid coolers, having singular stacked tubular subassemblies, are in general use. Included are fluid coolers used in high pressure and low pressure applications, such as in the refrigeration, air conditioning, compressor, and the automotive industries. This invention is applicable to a variable flow, high pressure fluid cooler assembly where primary design criteria include controlling the hydraulic behavior of the fluid cooler by using in a first primary position in a composite stack, a first tubular type, paired plate panel subassembly having interior longitudinal, bilateral tubular fluid flow channels with low internal resistance to flow features; and in a secondary position in the stack, a second tubular type, paired plate panel subassembly with greater resistance to flow and having interior longitudinal, circular fluid flow channels with superior internal heat transfer features, thereby minimizing heat exchanger package size while satisfying predetermined heat exchanger fluid flow capacity and heat transfer demand.

In the past, high pressure fluid coolers of this type have been designed primarily using a single tubular type, paired plate panel subassembly member in the fluid cooler stack wherein when one fluid cooler design parameter is enhanced, that enhancement may be adverse to other fluid cooler design parameter characteristics.

In certain high pressure fluid cooler applications having a single, tubular type, paired plate panel subassembly, wherein the primary design parameter is to effect efficient heat transfer, the high pressure fluid cooler may have increased resistance to fluid flow and thus less control of the hydraulic behavior of the fluid cooler assembly.

In other high pressure fluid cooler applications having one tubular type of paired plate subassembly, heat transfer is enhanced by increasing the heat exchanger effective surface area by adding internal embossments which increase resistance to internal fluid flow, thereby requiring the heat exchanger to be enlarged in size to accommodate the greater fluid flow capacity required to effect the heat dissipation rate required by the heat producing source coolant.

This fluid cooler assembly invention, by bifurcation of tubular fluid flow, balances the various design parameter characteristics for high pressure fluid cooler assemblies by using a novel combination of different tubular type, paired plate panel subassemblies to control the hydraulic behavior of the fluid cooler assembly, optimize heat transfer, and provide a high pressure fluid cooler assembly of minimized package weight and size.

Therefore, this invention provides a dual balance of the attributes of two different tubular types of paired plate panel subassemblies, each different tubular type of subassembly maximizing different ones of the high pressure fluid cooler design criteria to optimize fluid cooler performance characteristics.

Furthermore, the inventor has determined and provided, for specific applications, the correct composite number and combination of the two, herein described, different tubular types of paired plate panel subassemblies and their specific location placement in the stack configuration of the high pressure fluid cooler.

It is, therefore, a principal object of the present invention to provide a composite stacked, high pressure fluid cooler assembly using two different tubular types of paired plate panel subassemblies to provide desired controlled hydraulic behavior of the fluid cooler and to balance various fluid cooler design parameter criteria to produce an efficient, high pressure fluid cooler that requires relatively small installation space while meeting the heat transfer and quantitative fluid flow capacity demand required by a particular heat generating source.

SUMMARY OF THE INVENTION

According to the invention, there is provided a variable flow, fluid cooler assembly having compositely stacked together, two different types of tubular heat exchanger comprising paired plate panel subassemblies adapted for conducting cooling fluids passing therethrough, which comprise substantially rectangular, paired embossed plates that are laminated and hermetically sealed together to define heat transfer, internal tubular fluid channeled panels integrated with external corrugated fin subassemblies for controlled fluid flow conductance and heat dissipation. Each different tubular type, paired plate panel subassembly has manifold inlet and manifold outlet end areas co-joined with therebetween a tubular central coplanar area, the tubular type, paired plate panel subassembly being formed by stacking laminated paired sets of single embossed plates, therein having opposed coplanar embossment sealing surfaces located equidistant above and below a horizontal common lamination coplane of the perimeter band region and the central flow channel region.

The single embossed plates are pair arranged and mated face-to-face to fabricate the paired plate panel subassembly, the end areas of the single embossed plates having openings therein to form inlet and outlet manifold headers, each manifold end area is adapted respectively for accepting inlet coolant fluid input to and for discharging outlet coolant fluid from the interconnected manifolds of the two different types of tubular, paired plate panel subassemblies, and to provide spacing therebetween for corrugated fin subassemblies placed above and below each tubular, paired plate panel subassembly to improve heat transfer.

The manifold end areas in combination with their tubular central coplanar region have plate embossment surfaces, respectively, with vertical equidistant heights extending to horizontal common lamination planes of their respective perimeter band region and central flow channel region, the sealing surface embossments of the single embossed plate are of uniform height in the longitudinal and lateral axes of the paired plate panel subassembly, and each single embossed plate when paired and joined together, causes the surface embossments of each tubular paired plate panel subassembly to be arranged longitudinally and laterally directly opposite matching plate embossment surfaces to provide for concave sealing contact surfaces, and convex tubular surfaces to mate with an opposing paired, single embossed plate.

The fluid cooler assembly thus formed comprises a composite stack with a corrugated fin subassembly integrated with two different types of tubular constructed, paired plate panel subassemblies, wherein the first tubular paired plate subassembly has a continuous center divider ridge subregion that provides two longitudinally separated, internal bilateral, linear flow channels, wherein the coolant fluid flows substantially unobstructed through each of the internal bilateral flow channels. When stacked in a first primary position in the fluid cooler assembly stack, the first paired plate panel subassembly heat exchanger construction provides for control of the hydraulic behavior of the fluid cooler by coolant fluid flow through the internal bilateral linear flow channel subregion designed for low resistance to fluid flow.

Structurally different, the second tubular paired plate subassembly is stacked in a secondary sequential position in the fluid cooler stack with a central dish-disc dimpled subregion having uniformly spaced-apart, alternating circular and oval heat transfer enhancing, dish-disced dimple shaped embossments located centrally in the central flow channel region, thus causing the fluid flowing through the central flow channel region to cross-mix longitudinally and circularly to improve heat transfer from the coolant fluid to the fluid cooler exterior fluid. This second tubular type of paired plate panel subassembly heat exchanger construction provides for efficient heat transfer of the coolant fluid passing through the fluid cooler assembly and minimizes fluid cooler assembly size and weight when compared to comparable fluid coolers.

Each of the tubular type paired plate panel subassemblies has attached thereto external corrugated fin subassemblies to increase the heat transfer efficiency of the heat exchanger. The paired plate panel subassembly in combination with the corrugated fin subassembly thus provide enhanced heat transfer and provide for an efficient and cost effective fluid cooler assembly.

It is accordingly an object of this invention to provide a finned, tubular heat exchanger with variable flow characteristics.

Another object of this invention is to provide a heat exchanger assembly with improved heat transfer characteristics of minimized size and weight.

A further object of the present invention is to provide a finned heat dissipating tubular heat exchanger comprised of a finned subassembly integrated with two different types of heat exchanger subassemblies comprising tubular, paired plate panel assemblies having different tubular central flow channel regions, one tubular central flow region adapted to provide control of the hydraulic behavior of the fluid cooler assembly and the second tubular central flow region adapted to provide good heat transfer characteristics.

BRIEF DESCRIPTION OF DRAWINGS

The preferred exemplary embodiment of the invention will hereinafter be described in conjunction with the appended drawings, and.

DESCRIPTION OF THE PREFERRED EMBODIMENT

Figure 1:
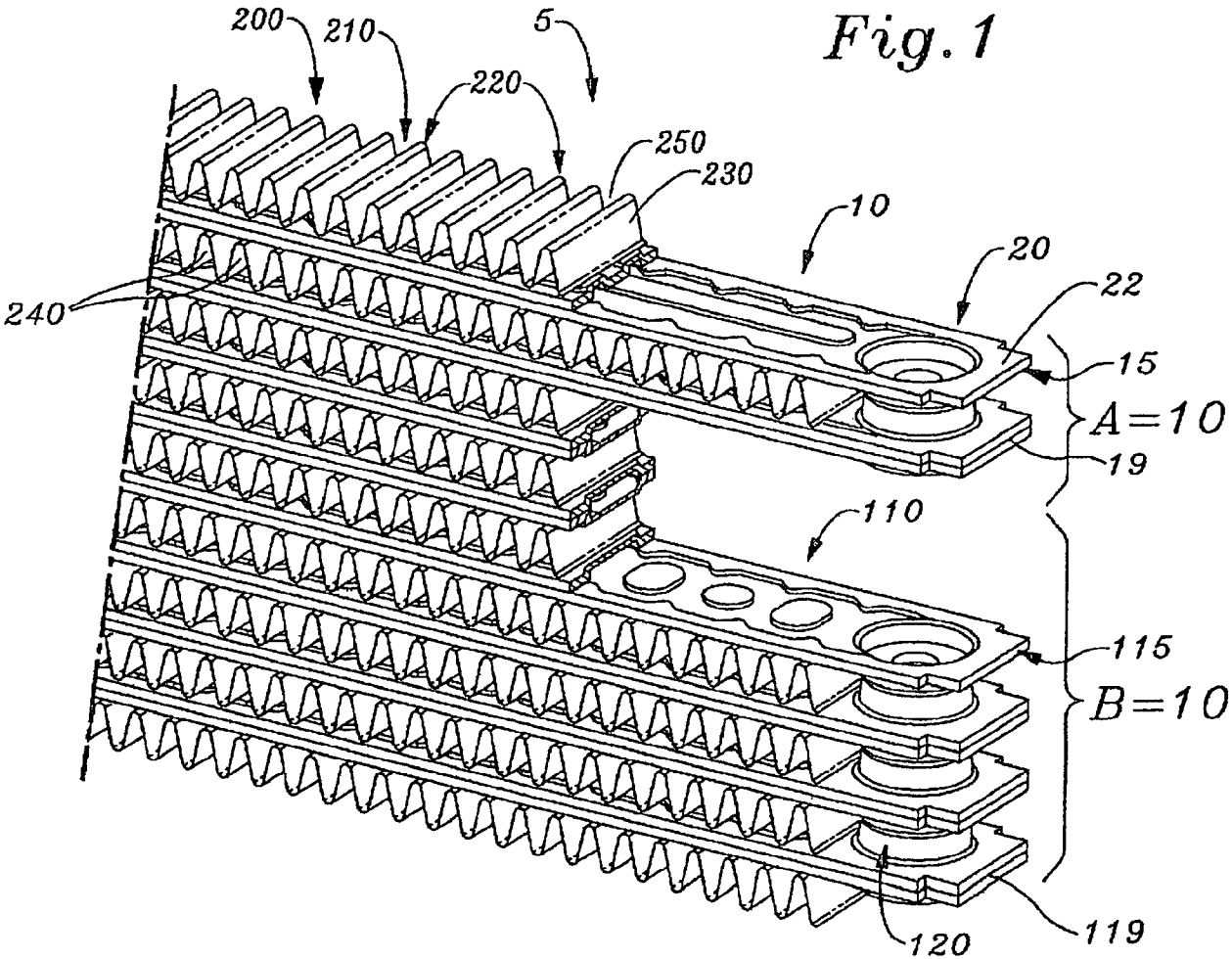
FIG. 1 is a perspective view of the high pressure fluid cooler invention.
Figure 2:
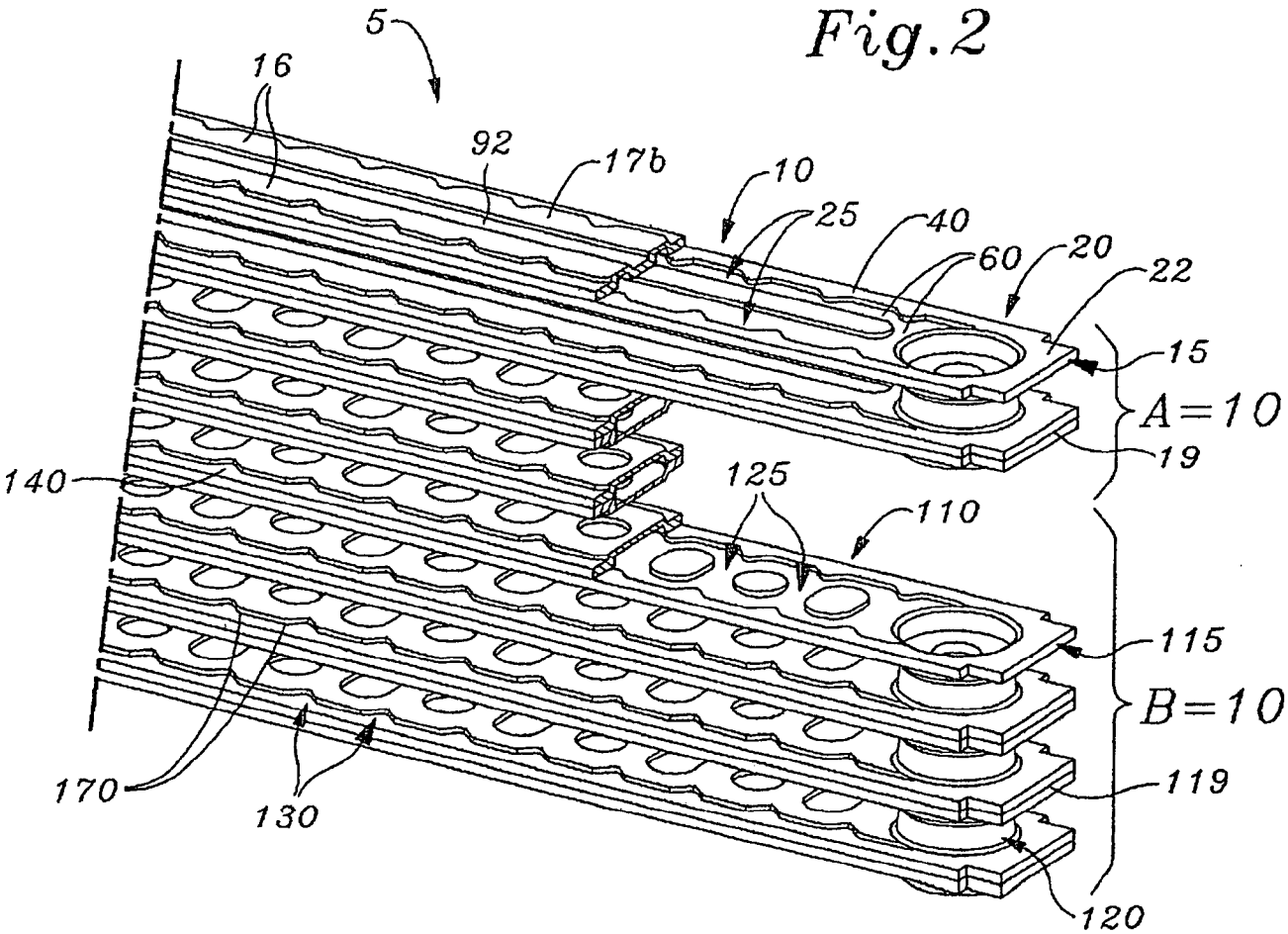
FIG. 2 is a perspective view of the first tubular, paired plate panel subassembly (type-A) in combination with the second tubular, paired plate panel subassembly (type-B).
Figure 3:
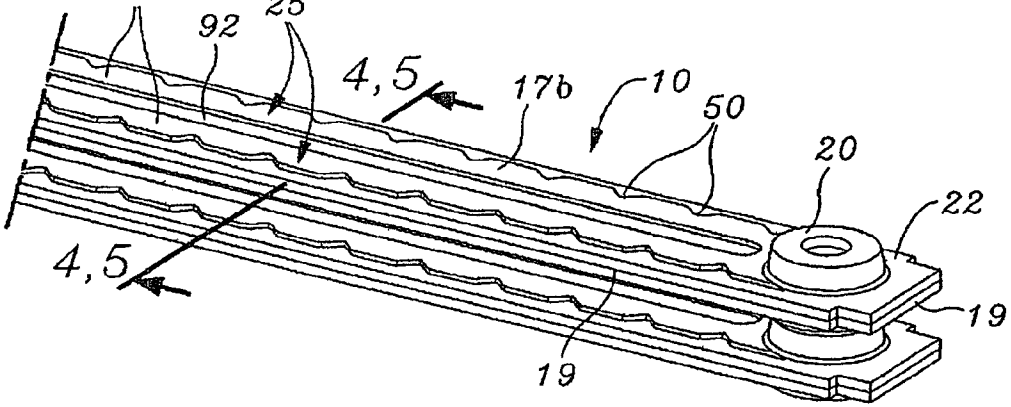
FIG. 3 is a perspective view of the first tubular, paired plate panel subassembly (type-A).
Figure 6:
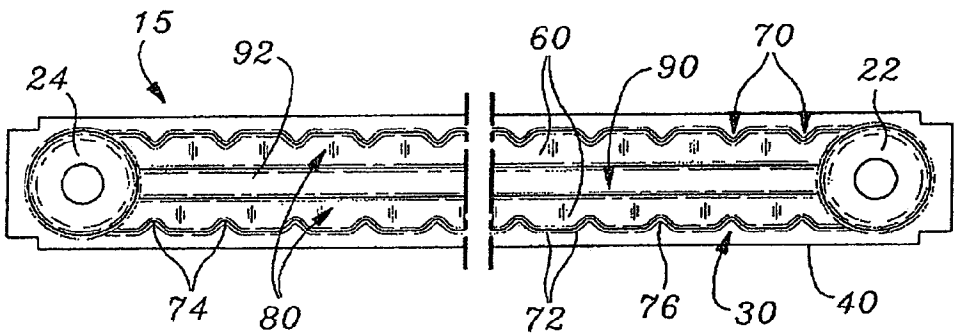
FIG. 6 is an enlarged top view of the first tubular, paired plate panel subassembly (type-A).
Figure 4:
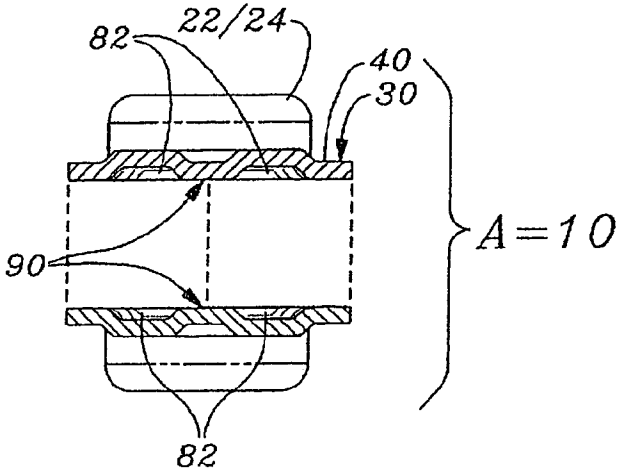
FIG. 4 is an exploded cross-sectional end view of the first tubular paired plate panel subassembly (type-A).
Figure 5:
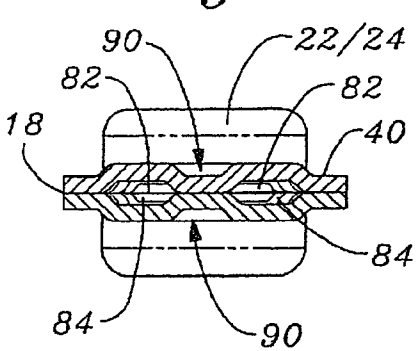
FIG. 5 is a cross-sectional end view of the first tubular, paired plate panel subassembly (type-A).
Figure 7:
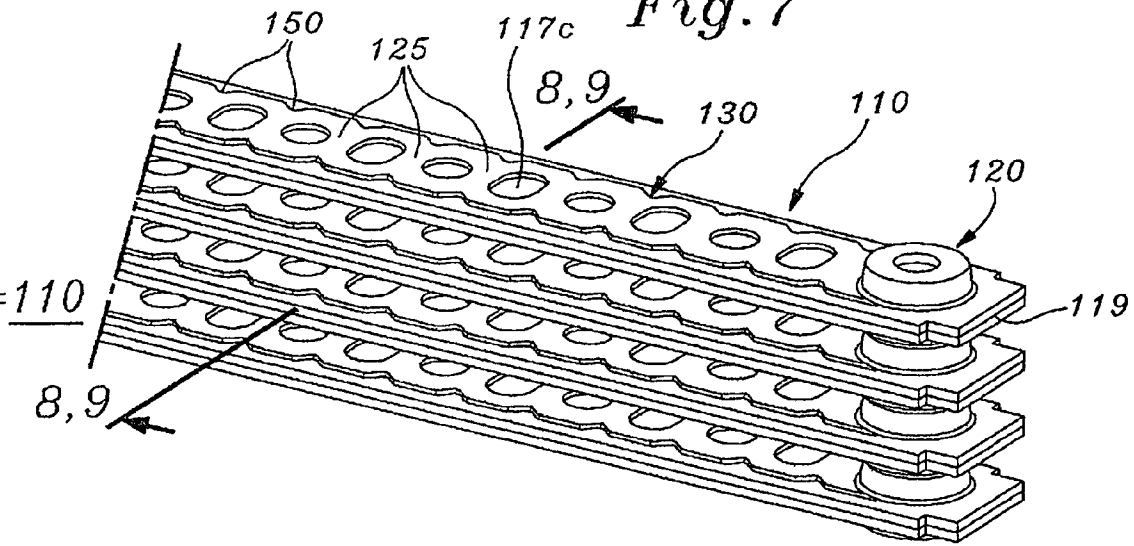
FIG. 7 is a perspective view of the second tubular, paired plate panel subassembly (type-B).
Figure 10:
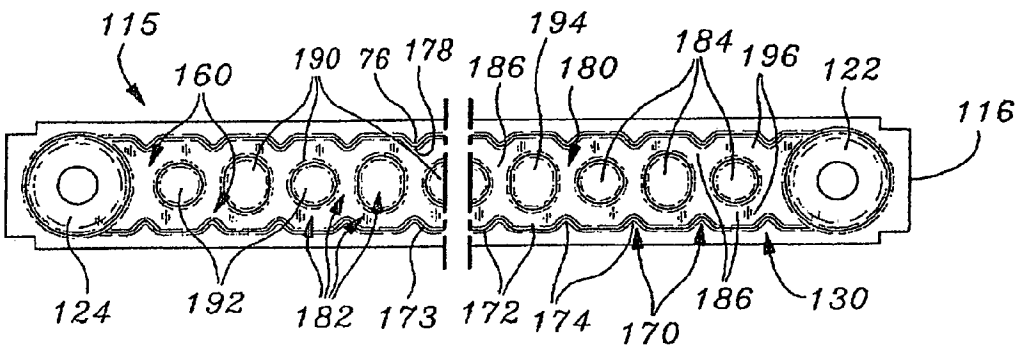
FIG. 10 is an enlarged top view of the second tubular, paired plate panel subassembly (type-B).
Figure 8:
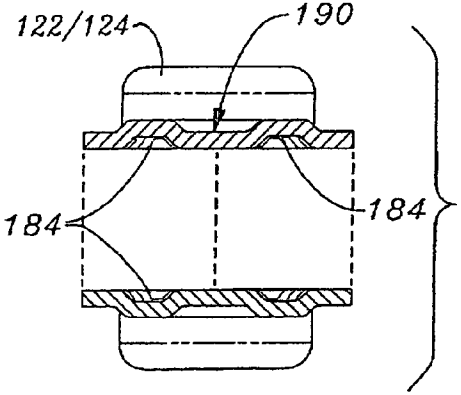
FIG. 8 is an exploded cross-sectional end view of the second tubular paired plate panel subassembly (type-B).
Figure 9:
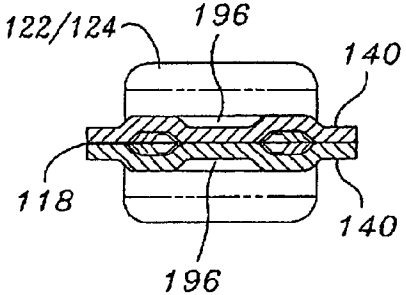
FIG. 9 is a cross-sectional end view of the second tubular, paired plate panel subassembly (type-B).

I. First Tubular, Paired Plate Panel Subassembly Type-A

As shown in FIGS. 1–13, a fluid cooler assembly 5 comprises two distinctly different types of tubular heat exchanger subassemblies; namely, a first tubular type-A heat exchanger 10, and a second tubular type-B heat exchanger 110. These two differently distinct types of tubular heat exchanger subassemblies are mutually joined together at their proximal and distal manifold ends by bell-shaped manifold interconnection and are externally surrounded by a finned corrugated subassembly 200 to form a vertical composite stack containing at least one tubular, paired plate panel type-A 10 heat exchanger subassembly and at least one tubular, paired plate panel type-B 110 heat exchanger subassembly with the surrounding finned corrugated subassemblies, together in combination, forming a novel, fluid cooler assembly 5 having controllable variable fluid flow and optimal heat transfer characteristics.

Each, of the two different tubular types of heat exchanger subassembly, is of paired plate panel construction, as described herein, with each tubular, paired plate panel subassembly type-A 10 differing from each tubular paired plate panel subassembly type-B 110 in interior tubular structural design. The differentiation between the type-A and type-B heat exchanger is that heat exchanger type-A has a central linear flow channeled subregion 60 and the heat exchanger type-B has a central cross-flow channeled subregion 160.

Each different tubular type of paired plate panel subassembly type-A 10 and type-B 110 is located in a specified, relative vertical composite stack position in the fluid cooler assembly 5, and that relative position in the vertical composite stack is determinate, firstly, for pre-selected control of the hydraulic behavior and secondarily, for optimization of the heat transfer characteristics of the fluid cooler assembly 5.

As shown in FIGS. 3–6, construction of the fluid cooler assembly 5, first tubular type-A heat exchanger comprises a first tubular, paired plate panel subassembly type-A 10 fabricated by joining together in a paired set, symmetrically paired, single embossed plates 15 to produce the first tubular, paired plate panel subassembly type-A 10.

Each tubular, paired plate panel subassembly type-A 10, has longitudinal opposing, bell-shaped manifold inlet and outlet end areas 20 having positioned therein between an internal channelized, tubular central coplanar area 25 designed for effecting heat transfer with relatively low resistance to fluid flow to thus facilitate control of the hydraulic behavior of the fluid cooler assembly 5.

The single embossed plates 15 have embossed flattened surfaces 16 with exterior concave sealing surface embossments 17*a*, exterior convex tubular embossments 17*b*, exterior concave ridgewall sealing surface embossments 17*c*, and exterior convex manifold surface embossments 19.

The sealing surface embossments 17*a* and 17*c* are hermetically sealed along an interior sealing lamination coplane 18, while the manifold sealing embossments 19 are conjoined and sealed together along a common manifold lamination coplane 26.

The tubular, paired plate panel subassembly type-A 10 is fabricated from at least one set of two, paired single plates 15 that are first surface embossed symmetrically to produce a series of longitudinal rows of flattened coplanar, exterior concave sealing surface embossments 17*a* for paired plate surface sealing fabrication purposes along a common interior sealing lamination coplane 18 and also have therein exterior convex embossments 17*b* for forming panel tubular channels for fabrication purposes.

When each, single embossed plate 15 is pair aligned with another opposing symmetrical, single embossed plate 15, each single embossed plate, thus paired as a set together, is then cojoined along the interior sealing lamination coplane surface 18 formed for a mating surface between paired sets of symmetrically opposing, single embossed plates 15 with exterior concave sealing surface embossments 17*a* and 17*c*.

Each single embossed plate 15 has longitudinal exterior concave and exterior convex flattened plate embossed surfaces 16 with vertical flattened exterior concave sealing surface embossments 17*a*, exterior convex tubular surface embossments 17*b* and exterior concave ridgewall sealing surface embossments 17*c* which, when laminated together to form a paired set with another opposing symmetrical single plate 15, is thereby hermetically sealed to an opposing single embossed plate exterior concave sealing surface embossments 17*a* and 17*c* in face-to-face relationship to form the interior sealing lamination coplane 18 for fabrication assembly of the paired plate panel subassembly 10.

In the tubular, paired plate panel assembly, corresponding end regions of the bell-shaped manifold inlet and outlet end areas 20 are interconnected together, respectively, in an axial alignment to form a proximal end inlet manifold region 22 and a distal end outlet manifold region 24.

The single embossed plate 15, flattened exterior convex manifold embossments, being of equal manifold vertical height, are longitudinally coplanar and co-joined together in the manifold lamination coplane 26 of the paired plate panel subassembly 10, to thereby, form the connecting bell-shaped manifold end areas 20.

After fabrication, when viewed longitudinally and in cross-section, the fabricated first tubular, paired plate panel subassembly type-A 10 includes bell-shaped manifold inlet and outlet end areas 20 that are connected longitudinally there between by a longitudinal, tubular central coplanar area 25 centrally and are coplanar positionally spaced between the proximal end inlet manifold region 22 and the distal end outlet manifold region 24.

The bell-shaped manifold inlet and outlet end areas 20 form the first functional region of the first tubular, paired plate panel subassembly 15 and are adapted to receive high temperature coolant fluid 7 from a heat-generating source for the heat exchanger process, and thereafter, discharge the processed heat-extracted coolant fluid for return to the heat generation source for renewed heat absorption and 6 recycling.

The coplanar tubular central area 25 forms the second functional region and is adapted for tubular channel conduction and heat extraction from the coolant fluid 7 as the fluid passes through the first tubular, paired plate panel subassembly type-A 10.

The first tubular, paired panel subassembly 10, coplanar tubular central area 25 is substantially rectangular and after fabrication comprises a heat exchanger structure with an outer perimeter band region 30 and an inner tubular central linear flow channel region 60.

The perimeter band region 30 forms the outer envelope of the first tubular, paired plate panel subassembly type-A 10, and is the first lateral area of the perimeter band region of the first tubular, paired plate panel subassembly type-A 10 comprising: (1) the perimeter band outer rim subregion 40; (2) the perimeter band inner lamination subregion 50; and (3) the common serrated sidewall subregion 70, wherein all perimeter band subregions have embossed flattened surfaces with coplanar exterior concave sealing surface embossments 17*a* to form a portion of the tubular interior sealing lamination coplane 18 for laminating and hermetically sealing the coplanar concave sealing surface embossments 17*a* together in paired sets of tubular paired, single embossed plates 15 for the fabrication of the first tubular, paired plate panel subassembly type-A 10.

The perimeter band inner lamination subregion 50 has exterior concave sealing surface embossment surfaces 17*a* that hermetically seal the tubular, paired plate panel subassembly type-A integrating together coincidentally along the common serrated sidewall subregion 70 of the central linear flow channel region 60.

Viewed laterally in cross-section, the coplanar tubular central area 25 has two functional lateral regions disclosing an outer perimeter band region 30 and an inner central linear flow channel region 60.

When hermetically sealed together, the paired, single embossed plates 15 flattened exterior concave sealing surface embossments 17*a* structurally reinforce the perimeter outer rim subregion 40 of the fluid tubular, paired plate panel subassembly type-A 10.

Viewed laterally inward from the perimeter band region outer rim 40 is the perimeter band lamination subregion 50. The perimeter band lamination subregion 50 is located laterally between the perimeter band outer rim subregion 40 and the common serrated channel sidewall subregion 70 of the tubular central area 25, and defines an internal perimeter portion of the horizontal surface area of the internal sealing lamination coplane 18 for the single embossed plates 15 lamination sealing process, together in plate sets, to form the first tubular, paired plate panel assembly type-A 10.

The tubular, paired plate panel subassembly type-A 10 central linear flow channel region 60 is defined by: (1) the common serrated channel sidewall subregion 70; (2) the bilateral linear flow channeled subregion 80; and (3) the center divider channel ridgewall subregion 90.

The common serrated channel sidewall subregion 70 forms one internal tubular channel boundary of the central linear flow channel region 60 that confines the coolant fluid 7 flow within the longitudinal tubular central flow linear channel region 60 defining the bilateral linear flow channeled subregion 80. The first lateral section of the bilateral flow channeled subregion 80 is thus located between the first lateral common serrated channel sidewall subregion 70 and the center divider channel ridgewall subregion 90, and the second lateral section of the flow channeled subregion 80 is positioned between the second lateral internal serrated sidewall subregion 70 and the center divider channel ridgewall subregion 90.

The central linear flow channel region 60 thus comprises a common serrated channel outer sidewall subregion 70, a center divider ridgewall subregion 90, and therebetween, for fluid flow cooling purposes, the longitudinal, bilateral flow channeled subregion 80.

In the first tubular, paired plate panel subassembly type-A 10, the internal coolant fluid is bifurcated and a first portion of the coolant fluid 7 passes through the first lateral section of the bilateral linear flow channeled subregion 80 that is formed between the first lateral common serrated sidewall subregion 70 and the center divider ridgewall subregion 90; and the second portion of the coolant fluid 7 passes through the second section of the bilateral linear flow channeled subregion 80 that is positioned between the center divider channel ridgewall subregion 90 and the second, serrated sidewall channel subregion 70. The center divider channel ridgewall subregion 90 divides the first tubular, paired plate panel subassembly type-A 10 into dual, first and second bilateral flow channeled subregions 80 by the longitudinal, bilateral embossed surface having flattened channel exterior concave sealing surface embossments 17*a* defining the dual channels 84 with central axes longitudinally parallel with the longitudinal portions of the perimeter band outer rim subregions 40.

The common serrated channel sidewall subregion 70 is laterally located in the common inner perimeter area between the perimeter band region 30 and central linear flow channel region 60 and has serrated, triangular shaped, aligned embossments forming the common serrated channel sidewall subregion 70 of the bilateral linear flow channeled subregion 80 that conducts the coolant fluid 7 through the first tubular, paired plate panel subassembly type-A 10.

The central flow channel 60, common serrated sidewall subregion 70 has an inwardly facing, triangular ribbed, embossed surface section 72 with apexes 76 facing the center divider channel ridgewall subregion 90.

The triangular rib embossed surfaces 72 preferably have a triangular cross-section 73 with a triangular rib baseline 74 and an apex 76.

The triangular embossed surface section 70 has flattened, exterior concave sealing embossment surfaces 17*a* for the coplanar paired set embossment mating fabricating process and is an integral portion of the inner sealing lamination coplane 18. The rib apexes 76 are preferably approximately ⅛" in length and have a baseline separation between corresponding adjacent triangles of approximately ¼" facing inward toward the center divider channel ridgewall subregion 90.

The central linear flow channel region 60 includes a center divider channel ridgewall subregion 90 that divides the first tubular, paired plate panel subassembly type-A 10, central linear flow channel region 60, into two symmetrical, bilateral linear flow channeled subregions 80, the coolant fluid in each central linear bilateral flow channel of the bilateral linear flow channel subregion 80 flows longitudinally and substantially independently of the fluid in the adjacent bilateral channel. The serrated triangular ribs 72 therein increase turbulence of the fluid flow through the tubular central coplanar area 25 for the tubular heat transfer area to optimize heat transfer efficiency and control the hydraulic behavior of the fluid cooler 5.

As shown in FIGS. 7–10, the second tubular, paired plate panel subassembly type-B 110 is placed in a secondary position in the composite stack, and has a basic structure similar to the first tubular, paired plate panel subassembly type-A 10, with the difference in structural design being that the second tubular, paired plate panel subassembly type-B 110 has a different tubular central cross-flow channel region 160 designed for optimizing heat transfer efficiency.

The second tubular, paired plate panel subassembly type-B 110 has single plate laminated panels of jointly paired plate sets, containing exterior concave surface disc-dished dimpled sealing surface embossments 117*c* equal in vertical height and internally spaced apart to cause cross-flow circulation of coolant fluid flow 7 circulating and cross-mixing both longitudinally and circularly through the central cross-flow channel region 160.

The second tubular, paired plate panel subassembly type-B, flattened embossments have embossed surface plates 116 with exterior concave sealing surface embossments 117*a* and 117*c* designed to maximize heat transfer in the central cross-flow channel region 160.

The first tubular, paired plate panel subassembly type-A 10 has a central linear flow channel subregion 60 with dual bilateral linear flow channels and a center divider channel ridgewall subregion 90, whereas the second tubular, paired plate panel subassembly type-B 110 differs and has instead, a central cross-flow channel region 160 with alternating, spaced apart, circular and oval dish-disc shaped, dimpled sealing surface embossments 117*c* to improve heat transfer efficiency.

The second tubular, paired plate panel subassembly type-B 110 external perimeter dimensionally resembles the first tubular paired plate panel subassembly type-A 10 and is substantially identically rectangular shaped, with embossed paired plates 115, having a proximal end inlet manifold region 122, a distal end manifold region 124 provided for accepting fluid flow, passing the fluid flow through the tubular central coplanar area 125, and then discharging the fluid through the distal end manifold region 124.

In the second tubular, paired plate panel subassembly type-B 110, similar to first tubular, paired plate panel subassembly type-A 10, the paired plate panel subassembly type-B 110, single embossed plates 115 have a tubular central coplanar area 125 with surface embossed exterior concave and exterior convex flattened sealing embossments 117*a* and 117*c* with top flattened embossed surface 116 mating along the common sealing lamination coplane 118. The embossed plate flattened external sealing surface embossments 117*a* and 117*c* respectively are uniformly equal in vertical height and sealed jointly together; external concave sealing surface embossment 117*a* sealed to a mating external concave sealing surface embossment 117*a*; external dish-disc dimpled concave sealing surface embossments 117*c*; sealing to mating external disc-dished dimpled concave sealing surface embossments 117*c* in face-to-face relationship.

The perimeter band region 130 comprises the subregions defined as perimeter rim outer band subregion 140, the band lamination subregion 150, and the common serrated channel sidewall subregion 170.

The second tubular, paired plate panel subassembly, type-B 110 manifold areas are identical, when compared to the first tubular, paired plate panel subassembly type-A 10, bell-shaped inlet and outlet manifold end areas 120 comprising a proximal end inlet manifold region 122 and a distal end outlet manifold region 124. Proximal end inlet manifold regions 22 of the first tubular, paired plate panel subassembly type-A 10 and the proximal end inlet manifold regions 122 of the second tubular, paired plate panel subassembly type-B 110 are interconnected together to provide a fluid cooler assembly 5 continuous manifold to receive the high temperature inlet coolant fluid 7 from the heat source being cooled, and similarly, the respective distal manifold ends 24 and 124 are tubular interconnected together to provide a fluid cooler assembly 5 discharge manifold outlet for the coolant fluid 8 fluid return back to the heat source to constitute the recycle cooling process for the heat source fluid.

The concave sealing surface embossments 117*a* and 117*c* are hermetically sealed along an interior sealing lamination coplane 118, and the manifold sealing embossments are cojoined and sealed together along a common manifold lamination coplane 126.

Between the second tubular, paired plate panel subassembly type-B 110 proximal end inlet manifold region 122 and the distal end outlet manifold region 124 is a tubular central coplanar area 125, having a perimeter band region 130 identical to that of the first tubular, paired plate panel subassembly type-A 10, with the second tubular, paired plate panel subassembly type-B 110 differing in internal construction because the central cross-flow channel region 160 is structurally adapted for enhanced heat transfer by providing larger heat transfer surfaces with exterior concave and exterior convex surface embossment areas with a greater heat transfer surface area than that of the first tubular, paired plate panel subassembly type-A 10.

Also similar to the first tubular, paired plate panel subassembly type-A 10, the second tubular paired plate panel subassembly type-B 110 has bell-shaped manifold end areas 120 and tubular central planar area 125 with plate embossed surfaces 116 having flattened exterior sealing surface concave embossments 117*a*, are equal in vertical height, and symmetrically shaped with plate embossed top surfaces 116 fabricated in a horizontal common sealing lamination plane 118, so that when hermetically sealed together, in face-to-face contact, form the second tubular, paired plate panel subassembly type-B 110 of the fluid cooler assembly 5.

The second tubular, paired plate panel subassembly type-B 110, perimeter band region 130 hermetically seals and confines the coolant fluid 7 within the second tubular, paired plate panel subassembly type-B 110, and includes: (1) the perimeter outer rim band subregion 140; (2) a perimeter rim common serrated channel sidewall subregion 170 having an inwardly facing triangular rib sidewall section 172; and therebetween (3) the band lamination subregion 150.

The perimeter band region 130 construction that includes the perimeter band outer rim subregion 140, the band lamination subregion 150, and the common serrated channel sidewall subregion 170, is substantially identical to the construction of the perimeter band rim 40, the perimeter band lamination 50, and the perimeter band serrated sidewall 70 of the first tubular, paired plate panel subassembly type-A 10 heat exchanger.

The second tubular, paired plate panel subassembly type-B 110 perimeter band region 130 structurally includes an inner band lamination subregion 150, that is located between the band outer rim 140 and the band common serrated channel sidewall subregion 170, performs the same function, and thus is similar to the inner lamination subregion 50 of the first tubular, paired plate panel subassembly type-A 10.

The common serrated channel sidewall subregion 170 has exterior concave embossments forming longitudinally aligned, orthogonal transverse, triangular rib sections 173 triangular in shape with a baseline parallel and inclusive within the common serrated channel subregion with an apex 178 facing the bilateral cross-flow channeled subregion 160 having centralized disc-dished dimpled embossments for cross-circulation.

The optimal triangular rib baseline subsection interior base spacing for desired fluid flow, has been determined to be in the range of twice the baseline distance between adjacent triangle baselines.

The central cross-flow channeled region 160 is channel defined by the common serrated sidewall subregion 170 and the bilateral cross-flow longitudinal channeled subregion 180, and contains dish-disc shaped dimples, instead of the center divider ridgewall subregion 90 of the first tubular, paired plate panel subassembly type-A heat exchanger.

Internally, equal-in-vertical height surface embossments, define the perimeter band outer sector regions with their respective inwardly facing triangular rib sectors spaced apart, equal in vertical height and in face-to-face uniform pattern sequence provide for optimized heat transfer by the coolant fluid flowing through the tubular channels of the high pressure fluid cooler assembly 5.

The second tubular, paired plate panel subassembly type-B 110 central cross-flow channel region 160, contains circular and oval disc-dished dimpled embossments, instead of the embossed continuous surface, solid divider ridgewall subregion 90 of the first tubular, paired plate panel subassembly type-A 10. The fluid flow through in the two longitudinal channels of the second tubular, paired plate panel subassembly type-B heat exchanger cross mixes as internal streams of fluid flow intermix together as the coolant fluid moves in longitudinal cross-flow streams and orthogonally collides with some of the fluid circling in a cross-flow pattern around and through the tubular, interior circular convex embossments centrally located in the bilateral cross-flow channeled subregion 180.

The first tubular, paired plate panel subassembly type-A 10, because of flow channel construction, has low resistance to flow to facilitate control of the hydraulic behavior of the cooler assembly 5 by controlling coolant fluid flow primarily through the first tubular, paired plate subassembly type-A 10.

In operation, the fluid cooler assembly 5, first tubular, paired plate panel subassembly type-A 10 proximal inlet manifold region 22 receives the coolant fluid 7 that enters the proximal end inlet manifold 22.

The interior primarily tubular design of the tubular, paired plate panel subassembly type-A 10 is to enhance control of the hydraulic behavior.

The interior primarily tubular design of the second tubular, paired plate panel subassembly type-B 110 is to effect efficient heat transfer of the fluid cooler 5.

The coolant fluid passes from the first tubular, paired plate panel subassembly type-A proximal inlet manifold region 22 into the coplanar tubular central area 25 and subdivides into two linear bilateral subflows for passage through the high pressure fluid cooler assembly 5 composite vertical stack comprising the first tubular, paired plate panel subassembly type-A 10 and the second tubular, paired plate panel subassembly type-B 110, that are vertically stack arranged in parallel alignment to control the fluid flow characteristics and effect efficient heat transfer for effectively cooling the coolant fluid 7.

Coolant fluid 7 in the first tubular, paired plate panel subassembly type-A 10 is conducted through the tubular central coplanar area 25 which includes a central linear flow channel region 60 having a serrated channel sidewall subregion 70, with a bilateral linear flow channeled subregion 80, and a center divider ridge subregion 90.

The coolant fluid flow 7 is channeled and confined within tubular, paired plate panel subassembly flattened exterior concave surface areas that are formed by the common lamination mating and sealing plane 18 defined by two symmetrical, paired set, single embossed plates, each of the paired, single embossed plate panels being substantially rectangular in shape and having surface embossments laterally across, alternating external concave and external convex surfaces defining a perimeter band region 30 and a tubular central coplanar area 25; the surface embossments having vertical equal-in-height embossments with coplanar flattened end lamination mating coplanar surfaces;

In the fluid cooler subassembly 10, the plates embossed surfaces 16, that are exterior concave and interior convex, form a common sealing lamination coplane 18 whereby their respective coplanar surfaces are equal in vertical height and are sealed together and hermetically laminated causing the paired, single embossed plates placed in face-to-face sealing surface embossment 17*a* to contact each other, and thereby produce a functional tubular, paired plate panel subassembly.

When in operation, the coolant fluid 7 flows though the central linear flow channel region 60 where the fluid in the tubular channel is dual symmetrical channel defined on each side by a right hand and a left hand common serrated sidewall subregion 70 and on the other side by the channel center divider ridgewall subregion 90, and therebetween by the bilateral linear flow channeled subregion 80.

The coolant fluid flow 7 impinges upon the channel serrated sidewall subregion 70, triangular sectors in the form of an equal leg triangle, wherein the common serrated sidewall subregion, triangular sections comprise isosceles triangles having included angles with rounded exterior and interior angle corners 78 to enhance fluid flow heat transfer and cross-mix the fluid flow passing therethrough.

The second tubular, paired plate panel subassembly type-B 110 causes enhanced heat transfer of the cooler assembly 5 by providing a tubular, central coplanar area 125 that differs from the first tubular, paired plate panel subassembly type-A 10 in that this area 125 has a bilateral cross-flow channeled subregion 180 with longitudinally aligned, axial centers of alternating, spaced apart, dished-disc dimpled, disced circular and oval embossments for providing combined circular and longitudinal orthogonal cooling fluid flowthrough.

After entering the inlet manifold of the fluid cooler assembly, portions of the coolant fluid concurrently enter the second tubular, paired plate panel subassembly type-B, proximal end inlet manifold 122 and is confined therein by the perimeter band region 130, comprising the band outer rim sub-region 140, the band laminating surface area 150 and the band inner channel sidewall subregion 170 and is therein confined to pass through the tubular central planar region 125 interior longitudinal central cross-flow channel region 160, where it then exits through the bell-shaped distal end outlet manifold region 124 to return to the heat generating source.

In the tubular central coplanar region 125 with an outer perimeter band subregion 140, a common serrated channel sidewall subregion 170, a disc-dished dimpled center channel subsection 190, and therebetween a bilateral cross-flow tubular flow channeled subregion 180, the coolant fluid 7 is decreased in temperature by heat transfer through the internal tubular areas and the external fin areas.

The second tubular, paired plate panel subassembly type-B 110 has a perimeter common serrated channel subregion 170 with an inwardly facing inner sidewall internal triangular rib sector 174 formed as a sidewall internal triangular rib sector 173 having a triangular rib base 174 and an apex 176. The apex 176 has a rounded top surface to turbularize the fluid flow and thereby to increase heat transfer. The central tubular planar region 125 has longitudinal common serrated channel sidewall subregions 170, a disc-dished dimpled center channel subregion 190, and therebetween a longitudinal bilateral cross-flow channeled subregion 180.

The tubular central coplanar area 125 has a panel centralized embossed region with a central cross-flow channel region 160 to decrease by heat transfer conduction the coolant fluid temperature.

The tubular central coplanar region 125 has a disc-dished dimpled center divider subregion 190 dividing the interior tubular channel 160 into a bilateral cross-flow channeled subregion 180 for improved heat transfer.

The coolant fluid 7 flows in the passageway formed between two band-inner channel sidewalls 170, are two inner sidewall internal triangular rib sections 173 in a central intermediate planar area 160 defining the longitudinal channel center dish disc-dimpled area 190. The inner perimeter rim band subsection 170 has an internal sidewall triangular rib subsection 173 with an apex 176 facing the dish-disc dimpled central divider subregion 190.

Figure 11:
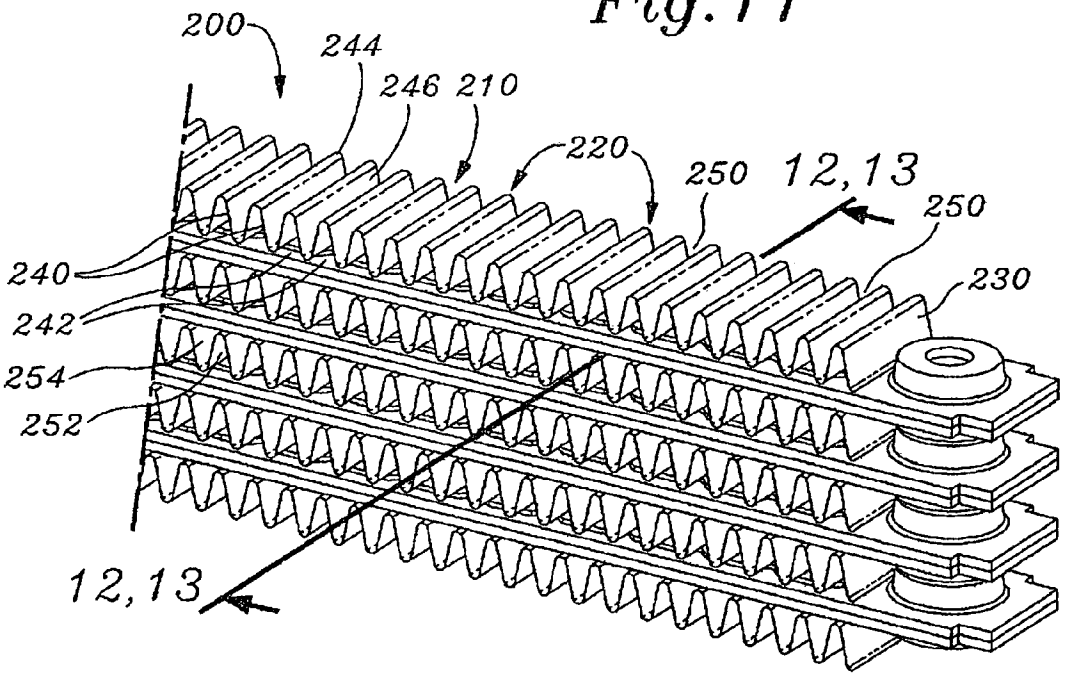
FIG. 11 is a perspective view of the corrugated fin subassembly.
Figure 12:
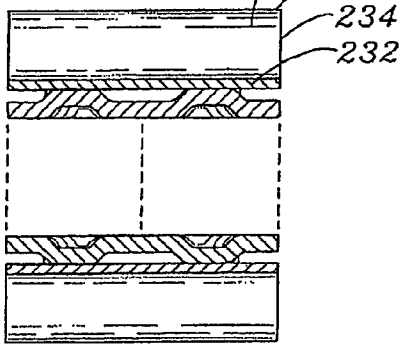
FIG. 12 is an exploded cross-sectional end view, of a corrugated fin section.
Figure 13:
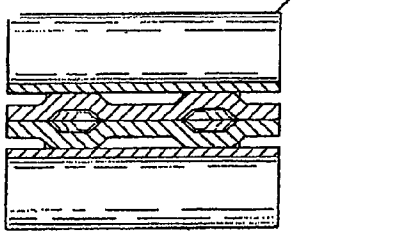
FIG. 13 is a cross-sectional end view of a corrugated fin section.

As shown in FIGS. 11–13, each tubular, paired plate panel subassembly, the first tubular, paired plate 1 panel subassembly type-A 10 and the second tubular, paired plate panel subassembly type-B 110, has an external enhancer corrugated fin subassembly 200 that is formed from a metallic strip of corrugated sheet metal foil 210. The corrugation strips have substantially longitudinally and equally, spaced-apart corrugations with a non-distortable, height-to-width ratio, and extend longitudinally substantially the full length of the paired plate panel subassembly. The heat transfer enhancer corrugated fin subassembly 200 surrounds each tubular, paired plate panel subassembly to improve the heat transfer effect and efficiency of the fluid cooler assembly 5 heat exchanger.

When viewed longitudinally, the enhancer corrugated fin subassembly 200 comprises a corrugated metal strip 210 having corrugations 220 as shown in the longitudinal cross-sectional corrugation area 230 that includes a triangular base 232, triangular legs 234, and an apex 236.

The metal strip 210 is fabricated into triangular corrugations including a longitudinal triangular surfaced subsection 230 having a longitudinal triangular base 232, longitudinal triangular legs 234, and longitudinal triangular apexes 236, and having a lateral triangular edged subsection 240 with a valley baseline 242, a ridge peak 244, and a rectangular sidewall face 246. The corrugated fin subassembly 200, thus formed has triangular passageways 250 having interior passageways 252 and exterior passageways 254 for increasing fluid cooler assembly 5 surface area and thus exposure to an external fluid cooling the fluid cooler assembly 5.

When viewed laterally the corrugation has a cross-sectional area including a flattened valley baseline 242, a flattened ridgeline 244, and a rectangular sidewall face 246.

The flattened valley baseline forms the bottom surface of the corrugations 220 and is rounded to make broad integrated surface contact and surfacially interconnect with the external convex tubular surfaces of the first tubular, paired plate panel subassembly type-A 10 and the second tubular, pared plate panel subassembly type-B 110. The corrugation ridgeline is designed to make good structural brazed contact with adjacent tubular, paired plate panel subassemblies and to provide a good heat transfer metal-to-metal corrugation surface connecting contact between an adjacent tubular, paired plate panel subassembly, thereby improving the heat transfer between a first tubular, paired plate panel subassembly type-A and a second tubular, paired plate panel subassembly type-B in the vertical stack to produce an effective and efficient heat exchanger assembly.

High pressure structural strength is provided by the lamination sealing together of internal, equal in vertical height sealing surface embossments 117*a* and 117*c* defining longitudinal tubular flow, central flow channel region 160 formed by joining and hermetically sealing together each embossed plate set to produce a respective tubular, paired plate subassembly having a coplanar laminated outer perimeter band region and an included laminated band inwardly facing interior triangle rib sections and interior central coplanar, and laminated disc-dished flattened, structurally shaped, alternating circular and oval sections embossed centrally in the longitudinal internal, centrally defined, planar area flow channel for imparting a second fluid flow sequence sacrificing structural strength and resistance to flow to maximize surface heat transfer.

In the second tubular, paired plate panel subassembly type-B 110, the coolant fluid enters the proximal inlet manifold area 122 and courses through the tubular central planar area 160, center divider disc-dish dimpled channel subregion 190 having alternating circular and oval shaped, centralized flattened disc-dished dimples and encountering resistance to flow and intermixing with orthogonal fluid flows to effect efficient heat transfer.

As shown in FIGS. 7–10, the dish-disced dimpled center channel subregion 190 in the second tubular, paired plate panel subassembly type-B 110 is comprised of alternating circular and oval shaped, central embossed convex-concave dimples 196 that improve heat transfer of the second tubular paired plate panel 110 but increase resistance to fluid flow through the high pressure fluid cooler.

As shown in FIGS. 7–10, the dish-disc dimpled center channel subregion 190 in the second, tubular type paired plate panel subassembly type-B 10, is composed of alternating circular and oval shaped, central embossed convex-concave dimples that improve heat transfer of the tubular type paired plate panel 10 but has high internal tubular structure increased resistance to fluid flow through the high pressure fluid cooler while exhibiting high heat transfer through the greater heat transfer surface area exposed to the heat absorbing external fluid.

Accordingly, the low resistance to fluid flow of the first tubular, paired plate subassembly type-A 10 and the enhanced heat transfer characteristics of the second tubular, paired plate panel subassembly type-B 110, in combination, produce a composite fluid cooler assembly 5 providing optimal balance in composite tubular, paired plate subassemblies for those high pressure cooler applications required in an optimized coolant fluid controlled flow, maximum heat transfer, and smaller compact package In the fluid cooler assembly, the first tubular, paired plate subassembly type-A 10 in combination with the second tubular, paired plate panel subassembly type-B 110 can optimize control of hydraulic fluid behavior heat transfer of the cooler and minimize high pressure cooler size because the first tubular, paired plate panel subassembly offers less resistance to fluid flow and thus has greater conductivity.

A fluid cooler assembly comprising all second tubular, paired plate panel subassemblies type-B cannot achieve substantial control of the hydraulic behavior of the fluid because of the high resistance to flow caused by the flattened dish-disced dimples that have enhanced heat transfer efficiency of the fluid cooler assembly 5.

Although there has been described above an improved high-pressure fluid cooler assembly in accordance with the present invention for purposes of illustrating the manner in which the present invention may be used to advantage, it is to be understood that the invention is not limited thereto. Consequently, any and all variations and equivalent arrangements, which may occur to those skilled in the applicable art, are to be considered to be within the scope and spirit of the invention, as set forth in the claims that are appended hereto as part of this U.S. Patent application.

We claim:

1. A fluid cooler assembly, which comprises:

a. a fluid cooler assembly stack having at least one, first tubular type, paired plate panel subassembly, connected together and spaced apart in series with at least one dissimilar, second tubular type, paired plate panel subassembly, and each said paired plate panel subassembly having a corrugated fin subassembly positionally attached above and below orthogonally therebetween;

b. each said tubular type, paired plate panel subassembly having a manifold inlet and outlet area defined by a proximal end inlet manifold region adapted for receiving coolant fluid input, a distal end outlet manifold region adapted for discharging said coolant fluid, and a tubular central coplanar area disposed therebetween said manifold inlet and outlet areas;

c. each said paired plate panel subassembly being fabricated by laminating together paired sets of symmetrical, single embossed plates in face-to-face, paired plate panel relationship to form said inlet and outlet manifold areas and said tubular central coplanar area;

d. said tubular central coplanar area having a perimeter band region and a corresponding central flow channel region, said perimeter band region laterally including a band outer rim subregion, a band lamination subregion, and a common serrated channel sidewall subregion, and said corresponding central flow channel region laterally including said common serrated channel sidewall integrated subregion, a bilateral linear flow channeled subregion, and a center divider channel subregion;

e. each said paired, single embossed plate having longitudinally aligned, surface embossments being disposed laterally across, and with alternating lateral regions defining said perimeter band region and said central flow channel region, said lateral surface embossments being equal in vertical height and defining a horizontal interior common sealing lamination plane;

f. said plate embossed surface sets mated and being sealed together to hermetically laminate said paired, single embossed plates in face-to-face contact to form said paired plate panel subassembly;

g. said common serrated channel sidewall subregion having longitudinally aligned, orthogonal transverse, triangular rib sidewall sections with spaced apart baselines parallel and inclusive within said common serrated channel sidewall subregion and having an apex facing said center divider ridgewall subregion;

h. said first tubular type, paired plate panel subassembly, central flow channel region having a longitudinal continuous, central divider ridgewall subregion for dividing said first tubular type, paired plate panel subassembly into dual bilateral linear flow channeled subregions with central axes longitudinally parallel with said center divider ridgewall subregion and adapted for providing a central longitudinal, coolant fluid flow in the bilateral linear flow channeled subregion for control of the hydraulic behavior of the fluid cooler assembly;

i. said second tubular type, paired plate panel subassembly having disposed therein a longitudinal, center divider disc-dimpled channel subregion with alternating oval and circular dimples axially centered and spaced apart adapted for providing a longitudinal cross-circular flow channeled subregion adapted for longitudinally cross-mixing coolant fluid flow in said bilateral cross-flow channeled subregion;

j. each of said paired plate panel subassemblies having attached and being positioned above and below in sealed contact externally with a corrugated fin subassembly formed from a strip of corrugated metal, extending substantially the length of each said paired plate panel subassembly; and k. said corrugated fin subassembly have a ridgeline in external contact with an adjacent said paired plate panel subassembly.

2. The fluid cooler assembly of claim 1, wherein said stack has at least one, first tubular type, paired plate subassembly placed in the first primary stacked position, for controlling the hydraulic behavior of the coolant fluid, and at least one, second tubular type, paired plate subassembly placed in a secondary stacked position.

3. The fluid cooler assembly of claim 1, wherein said second paired plate subassembly is heat transfer enhanced by said central flow channel region, embossment surface areas having alternating spaced apart, flattened oval and circular disc-dished dimples defining a longitudinal circular channeled sub-region to enhance heat transfer efficiency.

4. The fluid cooler assembly of claim 1, wherein said common serrated channel sidewall sub-region, triangular rib sidewall section is formed of triangles having rounded interior and exterior radii corners.

5. The fluid cooler assembly of claim 1, wherein said common serrated channel sidewall sub-region, triangular rib sidewall section is an isosceles triangle.

6. A fluid cooler assembly, which comprises:

a. a fluid cooler assembly stack having at least one, first tubular type, paired plate panel subassembly, connected together and spaced apart in series with at least one second, dissimilar tubular type paired plate panel subassembly, each said paired plate panel subassembly having a proximal end inlet manifold region adapted for receiving coolant fluid, a distal end outlet manifold region adapted for discharging said coolant fluid, and a tubular central coplanar area therebetween;

b. each said paired plate panel subassembly being fabricated by laminating together symmetrical, paired plate, single embossed plates in face-to-face relationship and having manifold inlet and outlet areas;

c. said tubular central planar area having a longitudinal perimeter band region and a corresponding central flow channel region, said perimeter band region laterally including a band outer rim subregion, a band lamination subregion, and an integrated common serrated channel sidewall subregion, and having also a corresponding said central channel region laterally including said common serrated channel sidewall subregion, a bilateral channel subregion, and a center divider ridgewall subregion and inlet and outlet manifold areas;

d. each said paired, single embossed plate having longitudinal surface embossments disposed laterally across, and with alternating lateral concave and convex surfaces defining said longitudinal perimeter band region surface areas and said longitudinal central flow channel region; said lateral surface embossments being equal in vertical height and defining a common horizontal lamination plane;

e. said surface embossment common mating surfaces being sealed together to hermetically laminate said paired, single embossed plates in face-to-face mating contact;

f. said common serrated channel sidewall subregion having longitudinally aligned, orthogonal transverse, triangular rib sidewall sections with baselines parallel and inclusive within said common serrated channel sidewall integrated subregion and having an apex facing said center divider ridgewall subregion;

g. said triangular rib sections having baselines being spaced apart, approximately two times the distance between adjacent triangular rib baseline subsections;

h. said central flow channel region having a longitudinal, continuous central divider ridge-wall sub-dividing said first, paired plate panel subassembly into dual bilateral channel sub-regions with central axes longitudinally parallel with said center divider ridgewall for controlling the hydraulic behavior of the coolant; and i. said second tubular type paired plate panel subassembly having a central flow channel region, circular channel subregion including a longitudinal, uniformly interrupted section in the tubular central channel subregion with axially centered and spaced apart, alternating oval and circular disc-dished dimples for providing combined longitudinal and orthogonal circular cooling fluid channel flow;

j. each of said paired plate panel subassemblies having attached and being positioned above and below in sealed contact externally with a corrugated fin subassembly formed from a strip of corrugated sheet metal foil, extending substantially the length of each said paired plate panel subassembly;

k. said corrugated fins having a non-distortable height-to-width ratio; and l. said corrugated fins have a ridgeline in external contact with an adjacent said paired plate panel subassembly.

7. The fluid cooler assembly of claim 6, wherein said stack has at least one, first paired plate panel subassembly being adapted primarily for controlling the hydraulic behavior of the fluid, and at least one second tubular type, paired plate panel subassembly.

8. The fluid cooler assembly of claim 6, wherein said second stacked paired plate assembly is heat transfer enhanced by said embossment surface areas, having alternating disc-dished dimples being alternating, spaced apart, oval and circular in shape to enhance heat transfer efficiency.

9. The fluid cooler assembly of claim 6 wherein said common serrated channel sidewall sub-region triangular sectors are triangles with approximately equal legs.

10. The fluid cooler assembly of claim 6 wherein said common serrated channel sidewall subregion triangular sections have truncated, rounded apexes.

11. The fluid cooler assembly of claim 6 wherein said common serrated channel sidewall subregion triangular sections are isosceles triangles having truncated, rounded apexes.

12. A fluid cooler assembly comprises:

a. a fluid cooler assembly stack having at least one first type, tubular paired plate panel subassembly connected together with at least one second type, dissimilar tubular paired plate panel subassembly to form a fluid cooler assembly;

b. each said tubular type, paired plate panel subassembly, being substantially rectangular in shape, having two sub-areas, one sub-area being a perimeter band region with a band outer rim subregion, a band lamination sub-region, and a common serrated channel sidewall subregion, and the second subassembly region being a central tubular planar area with a common serrated channel sidewall subregion, and therebetween, a longitudinal bilateral channel subregion;

c. said perimeter band region and said tubular central planar area being formed by the lamination mating of two symmetrical, paired, single embossed plates, each said paired, single embossed plate being substantially rectangular in shape and having surface embossments laterally across, alternating longitudinal convex and concave surfaces defining said perimeter band region and said tubular central planar region; said surface embossments having vertical equal-in-height projections with coplanar flattened end lamination mating surfaces;

d. said surface embossed plates having lamination mating surfaces being equidistant in vertical height and sealed together to hermetically laminate said paired plate, single embossed plates in face-to-face contact to produce said tubular, paired plate panel subassembly;

e. said perimeter band region and said central flow channel region in combination defining said substantially rectangular, tubular paired panel subassembly;

f. said central tubular planar area having a common serrated channel sidewall sub-region having interior longitudinally aligned, orthogonal transverse, triangular rib sections being triangular in shape with a baseline parallel and inclusive with said common serrated channel sub-region and with an apex facing said longitudinal interior center divider ridge-wall subregions;

g. said triangular rib baseline subsection being two times the baseline distance between adjacent triangles;

h. said tubular channel common sidewall subregion having an interior longitudinal center divider ridgewall subregion subdividing the first, paired plate panel subassembly into dual bilateral channel flow channels with central axes longitudinally parallel with the said longitudinal perimeter band outer rim subregions; and i. said second, tubular paired plate panel subassembly, tubular central planar region area having a longitudinal tubular circular channel sub-region with longitudinally aligned axial centers of alternating, spaced apart, dimpled, circular-oval disc-dished regions for providing combined circular longitudinal and orthogonal cooling fluid flow-through.

j. each of said paired plate panel subassemblies having attached and being positioned above and below in sealed contact externally with a corrugated fin subassembly formed from a strip of corrugated sheet metal foil, extending substantially the length of each said paired plate panel subassembly;

k. said corrugated fins having a non-distortable height-to width ratio; and l. said corrugated fins have a ridgeline in external contact with an adjacent said paired plate panel subassembly.

13. The fluid cooler assembly of claim 12, wherein said stack has at least one, first paired plate panel subassembly being adapted primarily for controlling the hydraulic behavior of the fluid cooler assembly and at least one second tubular type, paired plate panel subassembly.

14. The fluid cooler assembly of claim 12, wherein said second paired plate subassembly is heat transfer enhanced by said embossment surface areas, having equally spaced apart alternating disc-dished dimples being oval in shape to enhance cooling efficiency.

15. The fluid cooler assembly of claim 12, wherein said second paired plate subassembly is heat transfer enhanced by said embossment surface areas, having equally spaced apart alternating disc-dished dimples being circular in shape to enhance cooling efficiency.

16. The fluid cooler assembly of claim 12, wherein said second paired plate subassembly is heat transfer enhanced by said embossment surface areas, having equally spaced apart alternating disc-dished dimples being alternating oval and circular in shape to enhance cooling efficiency.

17. The paired plate cooler assembly of claim 12, wherein said common serrated sidewall subregion triangular sections are triangles having included angular, rounded exterior and interior angular corners.

18. The fluid cooler assembly of claim 12 wherein said common serrated channel sidewall subregion triangular sectors are triangles with approximately equal legs.

19. The fluid cooler assembly of claim 12 wherein said common serrated channel sidewall subregion triangular sections have truncated, rounded apexes.

20. The fluid cooler assembly of claim 12 wherein said common serrated channel sidewall subregion has equilateral triangular sections.

* * * * *